United States Patent [19]

Goto

[11] 4,034,330

[45] July 5, 1977

[54] SHEATH HEATER

[75] Inventor: Eizo Goto, Chigasaki, Japan

[73] Assignee: Tokyo Shibaura Electric Co., Ltd., Kawasaki, Japan

[22] Filed: Sept. 17, 1975

[21] Appl. No.: 613,974

[30] Foreign Application Priority Data

Sept. 19, 1974 Japan ..... 49-107965
Sept. 19, 1974 Japan ..... 49-112854

[52] U.S. Cl. ..... 338/238; 29/611; 219/342; 219/353; 219/544; 338/273; 338/274

[51] Int. Cl.[2] ..... H01C 1/03

[58] Field of Search ..... 338/238–243, 338/247, 273, 274; 219/342, 353, 538, 544; 29/610, 611, 613, 614

[56] References Cited

UNITED STATES PATENTS

| | | | |
|---|---|---|---|
| 1,992,787 | 2/1935 | Sutton | 338/238 X |
| 3,007,236 | 11/1961 | Barnes | 338/238 X |
| 3,307,017 | 2/1967 | Horstmann | 219/553 |

FOREIGN PATENTS OR APPLICATIONS

| | | | |
|---|---|---|---|
| 229,431 | 4/1959 | Australia | 29/611 |

*Primary Examiner*—C. L. Albritton
*Attorney, Agent, or Firm*—Oblon, Fisher, Spivak, McClelland & Maier

[57] ABSTRACT

A sheath heater comprises a pipe having two open ends, a pair of electrical terminals connected to a heat radiant body in the pipe, a region of electrically insulating powder having a high melting point and loaded inside the pipe to fix the heat radiant body, and a sealing member for the open end having a glass compound layer formed by a molten glass permeating into the insulating powder region at the open end.

7 Claims, 12 Drawing Figures

SHEATH HEATER

BACKGROUND OF THE INVENTION

1. Field of the Invention

This invention relates to a sheath heater, particularly to the improvement of the seal portions at the ends of a protector pipe.

2. Description of the Prior Art 8c 14 Alumina moisture penetrating

A conventional sheath heater comprises a metal protector pipe open at both ends, thereof an electrically heat radiant body provided along the central line of the protector pipe, and an electrically insulating powder of a high melting point loaded in the protector pipe to fix the heat radiant body. Alumina or molten magnesia powder, generally used as the insulating powder, moisture when exposed to open air, resulting in a decrease in the insulating property. To prevent the problem, the open ends of the protector pipe are sealed with silicone rubber, silicone resin, epoxy resin, glass, or the like. Electric terminals are provided in a penetrating manner through the sealings so as to contact the radiant body.

Resin used for the sealing is not satisfactory in air tightness and mechanical strength. In addition, it becomes brittle with age. This causes cracking and peeling of the resin, presenting free spaces between the resin seal and the protector pipe or the electric terminal. Glass also presents a racking problem. Generally, a molten glass is poured at the ends of the protector pipe to form sealings, resulting in thicker glass layers. As known well, a thick glass tends to be cracked when subjected to repeated temperature variations. The cracking or peeling of the sealing material allows the insulating powder to be exposed to open air and absorb moisture, resulting in breakdown of the powder, although the powder is heated prior to use at 500° C for removing water absorbed by and chemically combined with the powder. Attention should also be paid to the fact that an the electrically insulating property of glass is impaired at high temperatures.

In order to improve the drawback inherent in the sealing within resin or glass, there has been proposed a method in which a mixture of large grains of oxide having a high melting point and fine frits of a low melting point is loaded at the ends of the metal protector pipe and then to make the mixture an integral body. This method, however, is defective in that the fused sealing material comes to contain numerous fine cells. Thus, the reinforcing effect of the high melting oxide is greatly impaired. In addition, the method of fusion fails to exhibit satisfactory effects on preventing cracking and peeling of the seal formed. Being as such, a further improvement has been called for.

SUMMARY OF THE INVENTION

This invention has been achieved to eliminate the drawbacks inherent in the conventional technique. Specifically, this invention is intended to provide a sheath heater equipped with an air tight sealing, high in mechanical strength, and long in service life, and is featured in that the end of a protector pipe is sealed with glass compound prepared by dispersing a molten glass acting as a binder into electrically insulating powder having a high melting point.

BRIEF DESCRIPTION OF THE DRAWINGS

This invention will be fully understood when considered in conjunction with the accompanying drawings, wherein.

DETAILED DESCRIPTION OF THE ILLUSTRATED EMBODIMENTS

Figure 1:
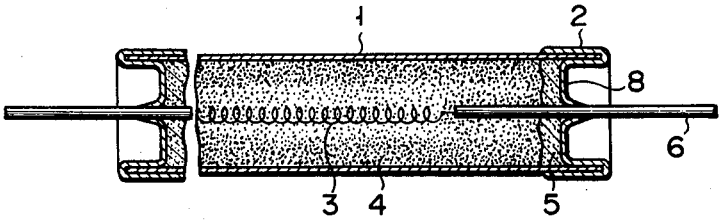
FIG. 1 is a cross sectional view of a sheath heater according to one embodiment of this invention.

FIG. 1 shows a sheath heater according to one embodiment of this invention. Reference numeral 1 denotes a protector pipe made of metal, crystallized glass, quartz glass or ceramics and having an open end portion 2. Reference numeral 3 represents an electrically heat radiant body like, for example, a nichrome wire extended along the central line of the protector pipe 1. A layer 4 of an electrically insulating high melting powder, such as a molten alumina powder (Alundum), a molten magnesia powder, or mica powder, is loaded inside the protector pipe 1 to fix the heat radiant body 3. A glass compound sealing or sealing member 5 is fused to the inside of the open end portion 2 of the protector pipe 1 to make the pipe 1 air tight. Reference numeral 6 denotes an electric terminal made of iron, soft steel or stainless steel extending through the sealing 5 to be connected to the radiant body 3. The surface of the sealing 5 is covered with a glass layer 8. The component and grain size distribution of the insulating powder layer 4 may be varied between the central portion and end portions of the protector pipe 1 or may be uniform throughout the pipe 1.

The sealing 5 comprises a glass compound prepared by allowing a molten binder glass to permeate into the insulating powder at the end portion of the protector pipe 1. The glass compound thus prepared is tightly adhered to the circumferential inner surface of the end portion 2 of the protector pipe 1 and around the electric terminal 6. It is important that the insulating powder have a melting point at least higher than that of the binder glass. A desired grain size distribution of the insulating powder is that the powder consists of various sizes of grains ranging from 40 meshes to 200 meshes.

An experiment was actually conducted using a soft steel pipe 10 mm in diameter as the protector pipe 1, a nichrome wire coil 100V 260W as the heat radiant body 3, a molten magnesia powder having a grain size distribution ranging from 40 to 200 meshes as the electrically insulating powder forming the layer 4, and a soft steel rod 2 mm in diameter as the electric terminal 6. These were assembled in a manner shown in FIG. 1 and, then, the end portion 2 of the pipe 1 was immersed for 30 seconds in a molten glass of $B_2O_3$—$SiO_2$—$B_aO$ type (the thermal expansion coefficient $107 \times 10^{-7}$° C, the softening point 581° C) heated to have a viscosity smaller than 100 poises.

Finally the end portion 2 was heated for 30 minutes at 800° C so as to allow the molten glass deposited to the end portion 2 to be melted and permeate into the insulating powder layer 4 near the end portion 2 of the protection pipe 1. Through these steps, the sealing 5 made of glass compound was formed in a desired thickness, for example, the sealing 5 having a thickness of 3 mm. In forming the sealing 5, the glass layer 8, thinner than 1 mm, was also formed on the outer surface of the sealing 5. Thus, the glass layer 8 was exposed to the atmosphere. The glass layer 8 this thin was easily cooled by the atmosphere. This served to prevent a remarkable decrease in the insulating property of the glass layer 8 while the sheath heater thus prepared was being put to practical use.

For reference, a method of producing a sheath heater is described in detail in the U.S. Pat. No. 3,522,028 entitled "Method of Bonding Part Together by Means of a Molten Glass Composition".

The sheath heater fitted with the sealing 5 made of glass compound is highly insulating under high temperatures, highly air tight because the glass compound is fused to the circumferential inner surface of the end portion 2 of the protector pipe 1 and to the electric terminal 6, and free from deterioration even if repeatedly used for many years. In addition, the glass compound absorbs mechanical and thermal shocks and distortions, thus eliminating the anxiety about occurrences of cracking and peeling and enabling the sheath heater to bear an extremely high mechanical strength. A voltage of 120V was applied across the sheath heater thus prepared for 10 minutes and then the power source was left disconnected for 10 minutes. These operations were repeated 100 times, with the result that no cracking or peeling was observed on the sealing 5, nor was the air tightness of the sealing 5 impaired. It is of importance to state that the sheath heater of this invention can be easily produced with less labor through the simple steps described above.

For comparison, an ordinary sheath heater was prepared using glass for forming the sealing of a protector pipe. In this case, the sealing tended to peel off soon after being formed and was inferior in air tightness. When subjected to the above-mentioned heating-cooling repetition test, the sealing was found to peel off completely. The decrease in insulating property was also found when the sealing was heated to 200 to 300° C during the heating period.

Figure 2:
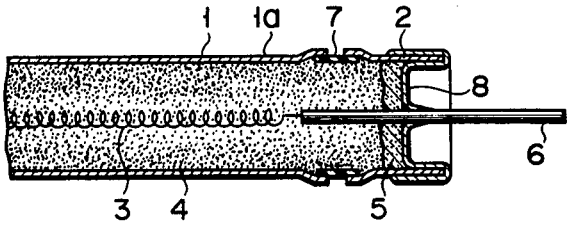
FIG. 2 is a partial cross sectional view of a sheath heater according to another embodiment of this invention.

In a sheath heater in which the end portion 2 of the protector pipe 1 is heated to high temperatures during the heating period, the glass compound constituting the sealing 5 comes to bear a lowered insulating property thus leading to a lowered insulation resistance between, the electric terminal 6 and the protector pipe 1. FIG. 2, in which the same reference numerals as in FIG. 1 denote the same members, shows a measure against the problem. Namely, the decrease in the insulation resistance mentioned above can be prevented by providing a circular heat-resistant insulating material 7, for example, a ceramics ring, between a body 1*a* of the protector pipe 1 and the end portion 2. The insulating material 7 is bonded air tight to the body 1*a* and the end portion 2. It is possible, in this connection, that the end portion 2 can be made of the insulating material 7 like ceramics in place of metal and the sealing 5 is directly fused to the insulating material 7.

Figure 3:
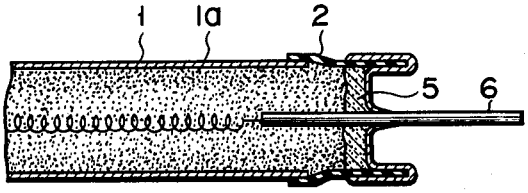
FIG. 3 is a partial cross sectional view of a sheath heater according to still another embodiment of this invention.

FIG. 3 shows another embodiment of this invention in which the protector pipe 1 consists of a metal body 1*a* and an end portion 2 made of an insulating material and fitted over the body 1*a*. The sealing 5 is fused to the circumferential inner surface of the end portion 2 and the electric terminal 6 extends outward through the sealing 5.

Figure 4:
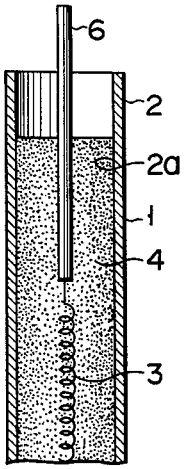
FIGS. 4 to 7 jointly show one example of the steps to prepare a sheath heater of this invention.

FIGS. 4 to 7 collectively show one example of the steps for sealing the end portion of the protector pipe so as to obtain a sheath heater according to one embodiment of this invention. As shown in FIG. 4, a rod of soft steel constituting the electric terminal 6 and the radiant body 3 connected to one end of the terminal 6 are provided first along the central line of the soft steel protector pipe 1 held upright with the upper portion constituting the open end. The protector pipe is 10 mm in outer diameter and 0.5 mm in thickness. The electric terminal 6 is 2 mm in diameter and the other end thereof extends outward through a portion 2*a* assigned for the sealing portion, also along the central line thereof. After the electric terminal 6 and the heat radiant body 3 have been provided inside the protector pipe 3, a layer 4 of an electrically insulating powder having a high melting point, for example, molten magnesia powder of 40 to 200 meshes, is loaded inside the protector pipe 1 to fix the heat radiant body 3. The layer 4 is allowed to reach the portion where the sealing is to be formed later.

Figure 5:
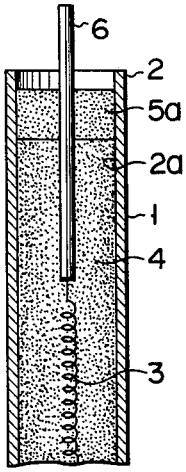

FIG. 5 shows the next step. Namely, loaded atop the powder layer 4 at the end portion 2 of the protector pipe 1 is a powdered glass 5*a* acting as the binder. Suitable for this purpose is $B_2O_3$—$SiO_2$—BaO glass (the thermal expansion coefficient $107 \times 10^{-7}$/° C, the softening point 581° C), which is the same as used in the first embodiment.

Figure 6:
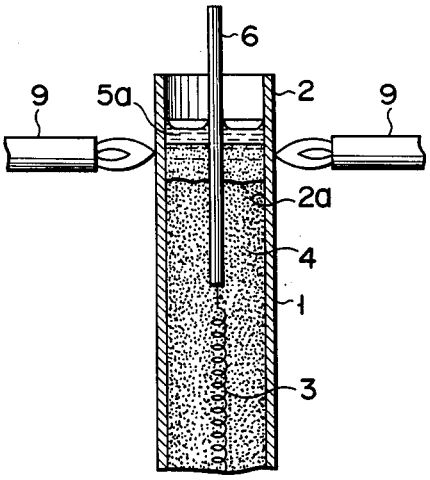

Then, the outer surface of the protector pipe 1 corresponding to the portion 2*a* where the sealing is to be formed is heated at about 800° C using burners 9 or an appropriate infrared ray device (not shown) as shown in FIG. 6. This causes fusion of the binder glass powder 5*a* and gradual entry of the fused glass powder into the insulating powder layer 4 having a higher melting point, enabling the insulating powder grains to be bonded firm so as to form glass compound around the portion 2*a*. The glass compound is adhered air tight to the circumferential inner surface of the portion 2*a*. Also, it is fused to the electric terminal 6. In about 3 minutes, a part of the molten binder glass forms a glass layer thinner than 1 mm on the outer surface of the glass compound just formed. At that time, the burners 9 are removed.

Figure 7:
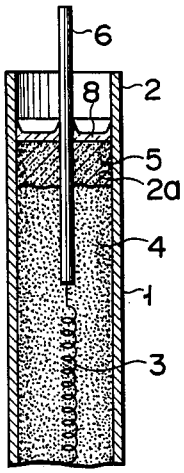

FIG. 7 shows the final state of the treatments. The high melting insulating powder 4 and the fused binder glass jointly form at the portion 2*a* of the protector pipe 1 the glass compound constituting the air right sealing 5 having a desired thickness, for example, a sealing 5 mm thick. At the same time, a part of the fused binder glass is bonded to the circumferential inner surface of the portion 2*a* and to the electric terminal 6 and forms the glass layer 8 thinner than 1 mm on the outer surface of the sealing 5. Accordingly, the sealing 5 is rendered perfectly air tight and a satisfactory electric insulation is attained between the electric terminal 6 and the protector pipe 1.

It is customary in a sheath heater that electric terminals extend from both ends of the protector pipe. Accordingly, the provision of the sealings at both ends of the protector pipe is recommendable. In the present invention, the air tight sealing is formed by bonding together the grains of high melting insulating powder with fused binder glass. This presents an additional merit that the sealing can be effected without fail even if there is a slight difference in pressure between the outside and inside of the protection pipe. To the contrary, it has been found that the sealing can be effected more satisfactorily where the internal pressure is several mmHg lower than the external pressure.

Figure 9:
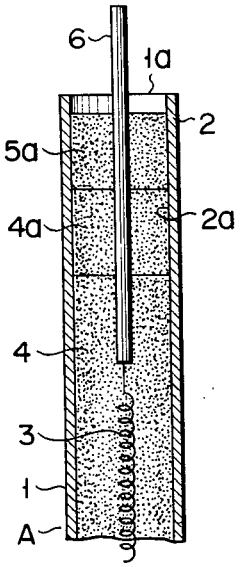
FIG. 9 is a partial cross sectional view showing one of the steps to prepare a sheath heater of this invention.

In the sealing preparation steps shown in FIGS. 4 to 7, the insulating powder 4 loaded at the portion 2*a* where the sealing 5 is to be formed was heated for melting the binder glass powder 4 loaded just above the portion 2*a*. Alternatively, it is possible to supply gradually the binder glass powder onto the insulating powder 4 prevously loaded and being heated at the portion 2*a*. As shown in FIG. 9, it is also possible to supply the same or different kind of insulating powder 4*a* into the portion 2*a* separately from the insulating powder 4 which fixes the heat radiant body 3. In this case, an appropriate amount of the binder glass powder 5*a* is loaded atop the insulating powder 4*a* and the molten binder glass is allowed to enter the insulating powder 5*a* to form an air tight sealing there. Further, a mixture of the binder glass 5*a* and the insulating powder 4*a* having an predetermined mixing ratio can be loaded in the open end portion 2. In this case, the sealing 5 free from cells is obtained if the portion 2*a* is heated while pressuring the loaded mixture.

Figure 8:
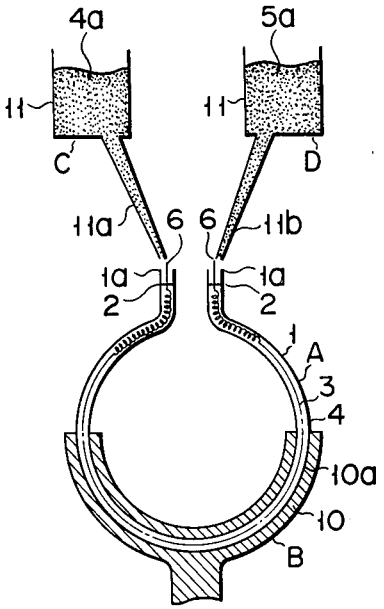
FIGS. 8 and 10 collectively show an apparatus to prepare a sheath heater of this invention.
Figure 10:
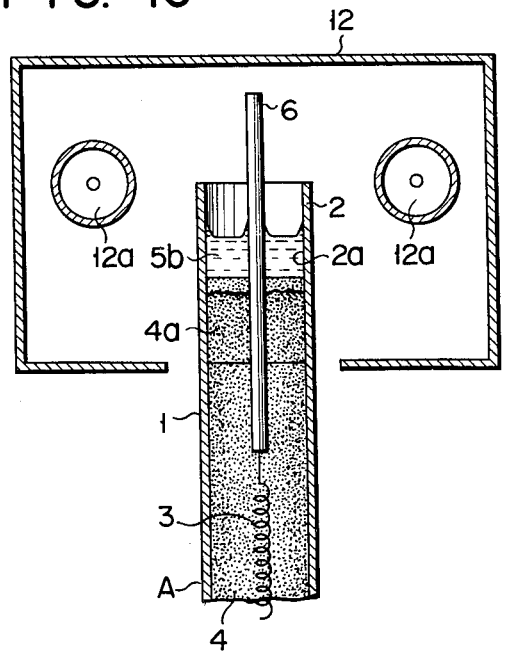

FIGS. 8 and 10 jointly show an example of an apparatus adapted to produce a sheath heater of this invention. FIG. 8 shows a step to load the electrically insulating high melting powder 4 and the binder glass powder 5*a* through the open end portion 2 into a non-sealed sheath heater. Capital letters A, B, C, D in the Figures respectively denote the non-sealed sheath heater, a support means of the non-sealed sheath heater A, a supply means of the insulating powder, and a supply means of the binder glass powder.

The non-sealed sheath heater A consists of the metal protector pipe 1 having open ends, the electrically heat radiant body 3 provided inside the protector pipe 1, rods of the electric terminals 6 each connected to either end of the radiant body 3, and the electrically insulating powder 4 loaded inside the protector pipe 1 to fix the radiant body 3.

The support means B is made of a semicircular cylindrical support body 10 mounted upright on an intermittent transfer device (not shown). The support body 10 is semi-circular in its circumferential cross section so as to form a semi-circular holding groove 10*a*. The protector pipe 1 is held in the groove 10*a* in a manner that the open end portions 2, 2 turn upright.

Hoppers 11, 11, each equipped with a vibrator, constitute the insulating powder supply means C and the binder glass powder supply means D. Pipes 11*a*, 11*b* extend from the bottoms of the hoppers 11, 11. The free ends of these pipes are arranged to rest just above openings 1*a*, 1*a* of the protector pipe 1 at the rest position of the support body 10. The insulating powder 4*a*, such as molten magnesia powder, molten alumina powder or mica powder, is loaded in one of the hoppers 11 and the binder glass powder 5*a* in the other hopper 11.

There will now be explained the step to load the insulating powder 4*a* and the binder glass powder 5*a* into the open end portions 2 of the protector pipe 1. The open end portions 2 of the non-sealed sheath heater A is heated first to 800° to 900° C to form oxide films on the surfaces of the protector pipe 1 and the electric terminals 6. This heat treatment can be applied to the non-sealed sheath heater A supported by the support means B or effected elsewhere.

The next step is to load the insulating powder 4*a* and the binder glass 5*a* into the open end portions 2 of the insulating pipe 1. In this step, the protector pipe 1 loaded with the insulating powder 4 is supported by the support means B. The electrically insulating powder 4*a*, which is the same as or different from the insulating powder 4 loaded in the pipe 1 in advance, is loaded first into the open end portion 2 on the right-hand side so as to form a layer upon the insulating powder 4, followed by supplying the binder glass powder 5*a* from the supply means D onto the layer of the insulaing powder 4*a* so as to form a layer of the glass powder 5*a*. Likewise, layers of the insulating powder 4*a* and the binder glass powder 5*a* are formed in the open end portion 2 on the left-hand side.

The non-sealed sheath heater A, supported by the support means B and loaded with the insulating powder 4*a* and the binder glass powder 5*a*, is allowed to pass through an infrared ray furnace 12 shown in FIG. 10. The infrared ray furnace 12 is provided with a pair of infrared ray irradiation means like, for example, quartz tube type infrared ray bulbs 12*a*, sheath heaters or infrared ray burners. When the non-sealed sheath heater A enters the furnaces 12, the open end portions 2 come most close to the infrared ray bulbs 12*a*. Quite naturally, the portion 2*a*, where the sealing is to be formed, is most strongly heated. It follows that the binder glass powder 5*a* is melted first, the molten glass 5*b* gradually permeating into the layer of the high melting insulating powder 4*a*. In the initial stage of the permeation, only the surface region of the insulating powder layer 4*a* is very hot and the molten glass 5*b* permeates shallowly into the insulating powder layer 4*a*. Accordingly, if a pressure difference is created between the inside and outside of the protector pipe 1 at this state, the gas is capable of passing through the molten glass 5*b* so as to retain equilibrium in pressure between the inside and outside of the protector pipe 1. But, as the molten glass 5*b* gradually permeates steeply into the insulating powder layer 4*a*, the gas passage into the outside of the protection pipe 1 becomes more and more difficult. FIG. 10 shows a state in which the molten glass 5*b* has permeated into the insulating powder layer 4*a* to some extent. Towards the end of the heating step, the molten glass 5*b* permeates down to the lower of the insulating powder layer 4*a*. The temperature of the lower region is considerably lower than at the surface region. Consequently, the molten glass 5*b* comes to hear a high viscosity there. It follows that the permeated molten glass grows tough enough to withstand a pressure difference between the inside and outside of the protector pipe 1. In addition, the molten glass 5*b* allows the insulating powder 4*a* to get wet enough to form together the glass compound constituting the sealing 5. Thus, an excessive permeation of the molten glass 5*b* is prevented and the sealing 5 is enabled to be free from residual cells. In this case, the glass compound is perfectly adhered to the circumferential inner surface of the open end portion 2 and around the electric terminal 6, thereby to attain perfect sealing of the open end portion 2. After passing through the region between the infrared ray bulbs 12*a*, 12*a*, the end portion 2 is cooled to form a thin glass layer 8 on the outer surface of the sealing 5. The glass layer 8 further improves the air tightness of the sealing 5.

An experiment was actually conducted using the apparatus described. A soft steel pipe, 10 mm in outer diameter and 9 mm in inner diameter, was used in this experiment as the protector pipe 1. The electrically heat radiant body 3 and the electric terminals 6 made of soft steel were housed in the protector pipe 1. Loaded inside the protector pipe 1 was molten magnesia powder as the electrically insulating high melting powder 4.

First of all, a voltage equivalent to 130% of the rated value was applied across the electric terminals 6 for 1 hour to dry the inner surface of the protector pipe 1 and the insulating powder 4, followed by heating with coal gas flame the open end portion 2 and the electric terminals 6 so as to form oxide films on the surfaces thereof. Then, molten magnesia powder of insulating to 200 meshes, acting as the insuating powder 4*a*, and a glass powder, the grain size ranging from about 0.5 to 2 mm, acting as the binder glass 5*a*, were loaded in the open end portion 2 of the protector pipe 1, as shown in FIG. 9. Each powder formed a layer of about 5 mm in thickness. The glass powder was obtained by grinding in water a glass of $PbO—B_2O_3—ZnO$ type (the thermal expansion coefficient $99 \times 10^{-7}/°$ C., the softening point 396° C).

The irradiation apparatus used was equipped with two infrared ray bulbs 12*a* of quartz tube type disposed 30 mm apart from each other, as shown in FIG. 10. When irradiated, the region between the two bulbs, each rated 100V, was heated to 700° C. to 800° C. The end portion 2 loaded with the insulating powder 4*a* and the binder glass powder 5*a* was disposed in this region and taken away 1 minute and 30 seconds later so as to cool and solidify the molten glass portion.

The open end portion of the sheath heater thus prepared was cut away to examine the cross section. It was found that the sealing 5 made of glass compound about 6 mm thick had been formed. The sealing 5 was quite free from cells, cavities or the like. It was also found that the circumferential inner surface of the open end portion 2 and the outer surface of the electric terminal 6 has been completely sealed air tight. The sheath heater thus obtained was also subjected to an electric insulation test, with very good result. The insulation resistance at normal temperatures was more than 2000 MΩ. Even during the current conducting time, the value exceeded 800 MΩ.

In the embodiment described, the insulating powder 4*a*, equal to or different from the insulating powder 4 fixing the heat radiant body 3, was loaded separately onto the layer of the insulating powder 4. Generally, the insulating powder 4 is densely loaded by swaging into the protector pipe 1. Thus, if the molten glass 5*b* is allowed to directly permeate into the powder 4, a longer time is required for the permeation. In contrast, the molten glass 5*b* relatively easily permeates into the insulating powder 4*a* loaded in the protection pipe 1 separately from the powder 4. It follows that the separate loading of the insulating powder 4*a* serves to improve the productivity of the sheath heater.

In the embodiment described, the glass acting as the binder was loaded in the form of powder. But, the binder glass can be used in molten state, etc.

Figure 11:
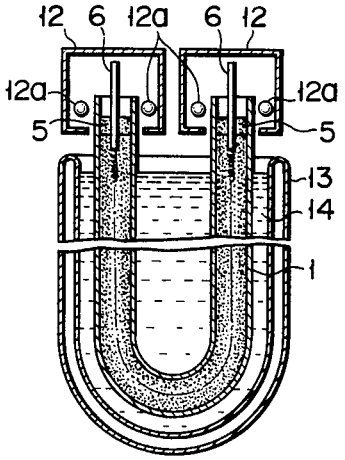
FIG. 11 shows another apparatus for preparing a sheath heater of this invention.

FIG. 11 relates to another method of producing a sheath heater of this invention. According to the method illustrated, the glass compound formed at the end portions of the protector pipe can be prevented from containing cells which would be formed otherwise because of a temperature difference between the inside and the outside of the protector pipe in the forming step of the glass compound. Further, the protector pipe can be enabled to contain gas of a pressure higher than the atmosphere. These combine to enhance the quality of the sheath heater produced.

The method of FIG. 11 will be explained in the following in conjunction with FIGS. 10 and 9. A nichrome wire coil or the like, constituting the electrically heat radiant body 3, is provided inside a metal pipe, constituting the protector pipe 1, which has open ends, and is, for example, U-shaped. Around the radiant body 3 is loaded molten magnesia powder, constituting the electrically insulating powder 4, having a high melting point. The magnesia powder has been heated in advance to 500° to 700° C. for drying and the grain sizes thereof range from 40 to 200 meshes. Rods of iron, stainless steel, etc., constituting the electric terminals 6, extend through the open end portions 1*a* to be brought into contact with the ends of the radiant body 3. At the end portions 2 of the protector pipe 1 and in contact with the insulating powder layer 4 are loaded the insulating powder 4*a*, like molten magnesia powder, and the binder glass powder 5*a*, one upon the other. The non-sealed sheath heater thus arranged is then transferred into the infrared ray furnace 12 in a manner as shown in FIG. 10. As described previously, the open end portions 2 of the protector pipe 1 are heated in the furnace 12.

A major feature of the method associated with FIG. 11 is that where is a vacuum flask 13 is filled with liquefied nitrogen 14 boiling at −196° C. As soon as the binder glass powder 5*a* begins to melt by the heating in the furnace 12, the major portion of the protector pipe 1, except the end portions 2, is immersed in the liquefied nitrogen housed in the vacuum flask 13 for the purpose of cooling. At this stage, the end portions 2 are kept heated by the infrared ray bulbs 12*a*. The cooling with the liquefied nitrogen 14 reduces the pressure of the gas like air present inside the protector pipe 1, preventing the flow of the gas to the outside, while the binder glass powder 5*a* is being sufficiently melted to permeate into the high melting insulating powder 4*a*, to form glass compound constituting the sealing 5, and adhered to the inner circumferential surfaces of the end portions 2 and the outer surfaces of the electric terminals 6. The molten binder glass has a higher viscosity in accordance with decrease in temperature. It follows in the system described that the molten glass does not permeate into the insulating powder layer 4*a* to an undesired extent. It never happens that the permeation reaches the insulating powder layer 4, the most part of which is immersed in the very cold liquefied nitrogen 14.

After being sufficiently heated, the end portions 2 are cooled by removing the infrared ray furnace 12. The molten glass 5*b* is rapidly solidified to form the sealing 5 of glass compound together with the insulating powder 4*a* at the end portions 2 of the protector pipe 1, as shown FIG. 7. Finally, the vacuum flask 13 is removed to allow the entire portion of the protector pipe 1 to be exposed to the open air, resulting in the protector pipe 1 being gradually raised to the room temperature and the gas pressure inside the pipe 1 being brought to a desired level.

It is preferred that the protector pipe 1 contain a dried gas having a pressure equal to or higher than the atmospheric pressure at a room temperature. In this case, the gas pressure inside the protector pipe 1 is increased to 3 atms. or higher when the sheath heater is kept switched on. Such a high internal gas pressure is very effective for preventing decrease in the insulation resistance between the electric terminal 6 and the protector pipe 1.

Figure 12:
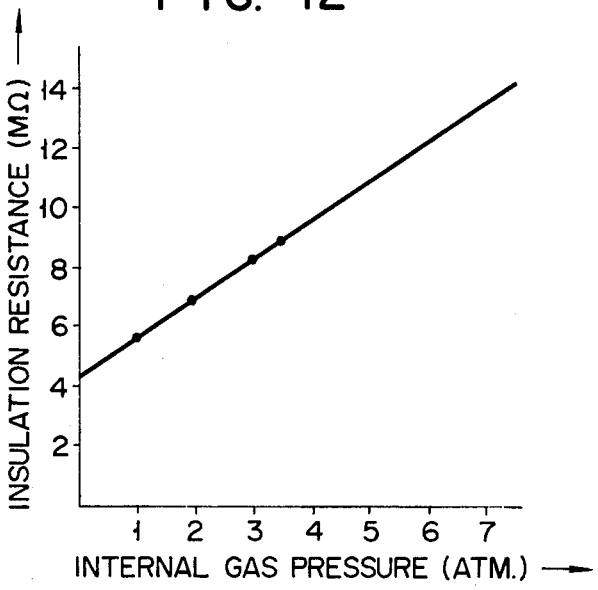
FIG. 12 is a graph showing the relationship between the internal gas pressure and the insulation resistance of a sheath heater.

FIG. 12 is a graph showing the relations between the internal gas pressure and the insulation resistance when the sheath heater was kept switched on. The sheath heater used for obtaining the data was 10 mm in outer diameter, 40 cm in the length of the heat radiant portion and rated 250V 850W. The graph of FIG. 12 clearly demonstrates that the higher the internal gas pressure, the higher the insulation resistance between the protector pipe and the electric terminal. voltage)

An additional test was conducted using a sheath heater 7.2 mm in outer diameter and 29 cm in the length of the heat radiant portion. The internal gas pressure of the heater was about 4 atms. when it was kept switched on. The power of the sheath heater when the insulation resistance becomes 1MΩ was experimentally obtained, the result being; 86*V* (terminal voltage) × 47 *A* (current) = 404 *W*. On the other hand, the surface power density of the protector pipe 1 at the radiant portion was;

$$(404/0.72 \times \pi \times 29 = 6.16\ W/cm^2$$

For the purpose of comparison, a similar test was also conducted using a conventional sheath heater sealed with a silicone resin. The internal gas pressure of the sheath heater was about 1 atm. at the current conducting time. The power when the insulation resistance becomes 1 MΩ was 82*V* (terminal voltage) × 4.55*A* (current) = 376*W*, and the surface power density was 5.9 W/cm².

The obvious conclusion is that it is extremely effective to allow the sheath heater to have a high internal gas pressure at the conducting time. The internal gas pressure should be at least equal to the atmospheric pressure at the heating time. Preferably, it should be higher than the atmospheric pressure at a room temperature.

Attention should be paid to the aspect of this invention that nitrogen and argon can be used as the gas contained in the protector pipe, as well as air.

The sealing method described provides prominent advantages. An excessive permeation of the molten glass 5*b* can be prevented, otherwise the insulation resistance of the sheath heater will be reduced by the softening of the permeated glass at the current conducting time. Also, the region between the sealing 5 and the circumferential inner surfaces of the end portions 2 of the protector pipe 1 are enabled to be free from cells and free spaces, presenting good air tightness and durability. In addition, it is possible to allow the protector pipe to contain gas of a pressure almost equal to or higher than the atmospheric pressure at the non-heating time. The simplicity of the apparatus used for producing the invented sheath heater is also worth mentioning.

An additional feature resides in the use of the liquefied nitrogen for the purpose of cooling. As soon as the sheath heater has been taken out of the liquefied nitrogen upon completion of sealing, the outer surface of the sheath heater is frosted. The frost then melts into liquid water and, if there are cracks or crevices on the protector pipe, permeates into the protector pipe. This causes reduction in the insulation resistance. Accordingly, bad protector pipes can be readily detected by simply examining the insulation resistance.

Besides the liquefied nitrogen, other cooling media, such as cooled water and ordinary water-works water, can be used for the purpose. The sole condition required is that the major portion of the protector pipe should be cooled below a room temperature at the time of sealing the end portions. Needless to say, the colder the better, because the internal gas pressure of the protector pipe is increased in proportion to the decrease in cooling temperature, thereby increasing the insulation resistance at the conducting time, as described previously.

The glass compound constituting the sealing 5 has a high insulation property. In addition, the glass layer 8, which normally presents decreased insulation, is made markedly thinner than the glass compound layer, say, for example, less than 1 mm, and exposed to the atmosphere. Thus, it is cooled by the atmosphere when the sheath heater is kept switched on. These combine to prevent a large reduction in the insulation resistance at the heating time.

In order to prepare the sealing 5 having an appropriate thickness, it is important to use a suitable amount of the binder glass powder 5*a*. An unduly thin sealing 5 renders the sheath heater unsatisfactory in terms of mechanical strength. It is also important to adjust the heating temperature and heating time so that the glass layer 8 formed on the surface of the sealing 5 may be thinner than 1 mm. The glass layer 8, if thicker than 1 mm, tends to peel off.

Attention should be also paid to the thermal expansion coefficients of the members constituting the sheath heater. Naturally, it is desired that the thermal expansion coefficients of the protector pipe 1, the electric terminal 6 and the glass compound constituting the sealing 5 be close to each other. The thermal expansion coefficient of the glass compound is determined by the composition of the binder glass, the composition and grain size of the insulating powder, and the mixing ratio of the two. Accordingly, the glass compound can be adjusted to provide a suitable thermal expansion coefficient.

As described in detail, the invented sheath heater comprises a protector pipe having open end portions, an electrically heat radiant body provided inside the protector pipe, an electrically insulating powder having a high melting point and loaded inside the protector pipe so as to fix the heat radiant body, a sealing made of glass compound prepared by allowing a molten glass acting as binder to permeate into an electrically insulating powder having a high melting point, such powder being the same as or different from the insulating powder fixing the heat radiant body, and an electric terminal extending through the sealing to be connected to the heat radiant body. The sheath heater thus constructed is prominent in its high electric insulating property, good air tightness, long life, and high strength against mechanical and thermal shocks. Such excellent properties are mainly due to the particular glass compound constituting the sealing 5.

What is claimed is:

1. A sheath heater comprising a pipe having at least one open end, an electrically heat radiant body provided inside the pipe, an electrical terminal connected to the heat radiant body, a region of electrically insulating powder having a high melting point and loaded inside the pipe to fix the heat radiant body, a sealing member for said open end having a glass compound layer formed by a molten glass permeating into the insulating powder region at said open end, and a glass layer formed on the outer surface of the glass compound layer being thinner than the glass compound layer.

2. A sheath heater according to claim 1, in which the glass layer has a thickness not thicker than 1 mm.

3. A sheath heater according to claim 1, in which said region includes first and second layers of the insulating powder, the second layer having a loading density smaller than that of the first layer and located on the side of the glass compound layer.

4. A sheath heater according to claim 1, in which the pipe is made of electrically conductive material.

5. A sheath heater according to claim 1, in which the pipe is made of electrically insulative material.

6. A sheath heater according to claim 1, in which said pipe includes a metal tube and an electrically insulating tube connected to the metal tube air-tightly and provided with said glass compound layer therein.

7. A sheath heater according to claim 1, in which said pipe includes first and second metal tubes and an electrically insulating tube interconnecting the first metal tube to the second metal tube.

* * * * *